US011730989B2

(12) United States Patent
Lee

(10) Patent No.: US 11,730,989 B2
(45) Date of Patent: Aug. 22, 2023

(54) SMALL SPACE FIRE EXTINGUISHER

(71) Applicant: Actiontech co., Ltd., Yongin-si (KR)

(72) Inventor: Hak Myeon Lee, Yongin-si (KR)

(73) Assignee: Actiontech co., Ltd., Yongin-si (KR)

( * ) Notice: Subject to any disclaimer, the term of this patent is extended or adjusted under 35 U.S.C. 154(b) by 28 days.

(21) Appl. No.: 17/482,623

(22) Filed: Sep. 23, 2021

(65) Prior Publication Data

US 2022/0168602 A1 Jun. 2, 2022

(30) Foreign Application Priority Data

Dec. 1, 2020 (KR) ..... 10-2020-0165838

(51) Int. Cl.
*A62C 35/10* (2006.01)
*A62C 3/16* (2006.01)

(52) U.S. Cl.
CPC ..... *A62C 35/10* (2013.01); *A62C 3/16* (2013.01)

(58) Field of Classification Search
CPC ..... A62C 35/10; A62C 3/16; A62C 37/11; A62C 13/62; A62C 3/008; A62C 33/00; A62C 35/02; A62C 35/13; A62C 35/64
USPC ..... 169/26, 51, 58, 62, 35
See application file for complete search history.

(56) References Cited

U.S. PATENT DOCUMENTS 8,024,849 B2 * 9/2011 Geyer ..... A62C 31/02 29/520
2016/0193489 A1 * 7/2016 Taniguchi ..... A62C 3/07 169/26
2021/0220682 A1 * 7/2021 Malovec ..... A62C 35/10

FOREIGN PATENT DOCUMENTS

KR 10-1918896 B1 11/2018

* cited by examiner

*Primary Examiner* — Christopher R Dandridge
*Assistant Examiner* — Juan C Barrera
(74) *Attorney, Agent, or Firm* — NKL Law; Jae Youn Kim

(57) ABSTRACT

A small space fire extinguisher includes: a tube open from one side thereof to the other side thereof and made of a synthetic resin so that a portion thereof bursts by the heat generated when a fire breaks out to allow a fire extinguishing agent accommodated therein to spout; cylindrical blocking members coupled to both sides of the tube to prevent the fire extinguishing agent accommodated in the tube from leaking to the outside; coupling members located on the outer peripheral surface of the tube, in the state where packing members are fitted to installation grooves of blocking member bodies, and then compressed thereagainst by means of a compression device; and blocking members fitted to both side ends of the tube to prevent the coupling members compressedly fixed to the outer peripheral surface of the tube to which the blocking members with the packing members are fitted.

1 Claim, 4 Drawing Sheets

SMALL SPACE FIRE EXTINGUISHER

CROSS REFERENCE TO RELATED APPLICATION OF THE INVENTION

The present application claims the benefit of Korean Patent Application No. 10-2020-0165838 filed in the Korean Intellectual Property Office on Dec. 1, 2020, the entire contents of which are incorporated herein by reference.

BACKGROUND OF THE INVENTION

Field of the Invention

The present invention relates to a small space fire extinguisher, and more particularly, to a small space fire extinguisher that is capable of injecting and accommodating a fire extinguishing agent such as a fire extinguishing liquid or gas into a tube, so that when a fire occurs in a small space, the tube bursts by the heat generated from the fire to allow the fire extinguishing agent accommodated therein to spout and scatter, thereby achieving initial fire suppression, and that is capable of allowing the tube having the fire extinguishing agent stored therein to be sealed on both ends thereof, thereby improving the perfect sealing of the tube and the stability and effectiveness in installation work.

Background of the Related Art

Generally, fires may occur naturally on mountain forests when the air is too dry, but most of fires and forest fires may break out due to carelessness of users or hikers. In addition, fires may occur frequently due to electrical defects, over-voltage, electric leakage, and gas supplied to houses. Accordingly, most of such fires may be considered as human-made disasters rather than natural disasters.

Further, if fires break out in buildings, fire suppression is carried out by fire stations close to the buildings and the assistance of civil defense members and local people, but in the case where initial fire suppression fails, unfortunately, buildings may be destroyed by the fires or human damages in the fires may be caused.

In most cases, accordingly, powder fire extinguishers are put in buildings to achieve initial fire suppression with ease. The powder fire extinguishers serve to suppress fires at initial stages of the fires, and to do this, there are various kinds of powder fire extinguishers. Normally, the powder fire extinguisher for spouting a powder fire extinguishing agent through a non-flammable high pressure gas (carbon dioxide or nitrogen), is put in a given place, and if a fire breaks out, the powder fire extinguisher is used to initially suppress the fire.

The powder fire extinguisher has to have a pressure gas tank additionally disposed in a container, and accordingly, it is complicated in configuration and it is hard for a user to control it.

Besides, the powder fire extinguisher has the fire extinguishing powder filled therein to a given pressure, and while being kept in a given place, accordingly, the pressure may be reduced. When the powder fire extinguisher is really used, in this case, the injection distance of the fire extinguishing powder may be shortened to cause fire extinguishing efficiencies to become low and to ensure no safety of the user.

So as to initially suppress fires caused due to electrical defects, over-voltage, and electric leakage, further, small space fire extinguishers have been developed and widely popular.

One example of the small space fire extinguishers is disclosed in Korean Patent No. 10-1918896 (Issued on Nov. 14, 2018) entitled "Fire extinguisher for distribution board", and the conventional fire extinguisher includes: a hose made of a soluble resin material, cut to a given length, and filled with a fire extinguishing agent; a first nozzle unit forcibly fitted to one side end of the hose to inject the fire extinguishing agent into the hose; and a second nozzle unit forcibly fitted to the other side end of the hose to exhaust air from the hose to the outside, while the fire extinguishing agent is being injected into the hose, wherein the first nozzle unit and the second nozzle unit include a first unit body and a second unit body made of an elastic material and sealedly fitted to one side end and the other side end of the hose, a first nozzle body and a second nozzle body insertedly passing through the first unit body and the second unit body, and a first one way valve and a second one way valve disposed on the first nozzle body and the second nozzle body and open to the inside of the hose; and the first unit body and the second unit body include a first fitting end and a second fitting end having outer diameters larger than the inner diameter of the hose and a first extending end and a second extending end extending from the first fitting end and the second fitting end and having diameters smaller than the diameters of the first fitting end and the second fitting end; the first nozzle body and the second nozzle body having a first screw end and a second screw end protruding from the end portions of the first extending end and the second extending end and screw-coupled to fire extinguishing agent injection nozzles; and the first nozzle body and the second nozzle body being located inside both ends of the hose so that caps are fitted to both ends of the hose to finish a product.

According to the conventional small space fire extinguisher, the first nozzle unit and the second nozzle unit are located on both sides of the hose, and if a fire breaks out, heat is applied to the first nozzle unit and the second nozzle unit, so that due to the heat, undesirably, the fire extinguishing agent may leak between the hose and the first nozzle unit or the second nozzle unit, thereby making it hard to initially suppress the fire.

SUMMARY OF THE INVENTION

Accordingly, the present invention has been made in view of the above-mentioned problems occurring in the related art, and it is an object of the present invention to provide a small space fire extinguisher that is configured to allow a portion of a tube to burst if a fire breaks out to generate heat with a temperature above a given value, so that a fire extinguishing agent such as a fire extinguishing liquid or gas, which is accommodated into the tube, momentarily spouts and scatters, thereby achieving initial fire suppression.

It is another object of the present invention to provide a small space fire extinguisher that is capable of being fixed to the inner surface of a small space like a distribution box or suspended in the small space by means of any one of a fixing holder with a fixing hole, a hook, a latch, and a wire, so that if a fire breaks out, the small space fire extinguisher can be used immediately to suppress the fire.

To accomplish the above-mentioned objects, according to the present invention, there is provided a small space fire extinguisher including: a tube open from one side thereof to the other side thereof and made of a synthetic resin so that a portion thereof bursts by the heat generated when a fire breaks out to allow a fire extinguishing agent accommodated therein to spout; cylindrical blocking members coupled to both sides of the tube to prevent the fire extinguishing agent accommodated in the tube from leaking to the outside; coupling members located on the outer peripheral surface of the tube, in the state where packing members are fitted to installation grooves of blocking member bodies, and then compressed thereagainst by means of a compression device; and blocking members fitted to both side ends of the tube to prevent the coupling members compressedly fixed to the outer peripheral surface of the tube from being exposed to the outside.

According to the present invention, desirably, each blocking member may include: the blocking member body inserted into an end of the tube; a coupling recess formed on the center of the blocking member body and coupled to the corresponding coupling member fitted to the outer peripheral surface of the tube to allow the coupling member to be fixed to the tube by means of the compression device so that the fire extinguishing agent can be prevented from leaking to the outside; and the installation groove formed at the center of the coupling recess of the blocking member body.

According to the present invention, desirably, the packing members may serve to prevent the fire extinguishing agent from leaking to the spaces between the tube and the blocking members through the coupling members fitted to the tube by means of compression.

According to the present invention, desirably, each coupling member may have the shape of a ring whose diameter is larger than a diameter of the tube.

Advantageous Effects of the Invention

According to the present invention, the small space fire extinguisher may be installed in small spaces, such as the interiors of home appliances, distribution boards, and the like, where it is hard to easily recognize the occurrence of fires, and if a fire breaks out, the tube bursts to allow the fire extinguishing agent stored therein to spout and scatter quickly, thereby performing initial fire suppression to prevent the fire from spreading.

According to the present invention, further, the small space fire extinguisher may be configured to allow the fire extinguishing agent stored in the tube to spout and scatter quickly, thereby performing fire suppression with ease, and configured to adjust the size of the tube according to the size of the small space where it is installed, thereby making it convenient to use.

According to the present invention, in addition, the small space fire extinguisher may be fixed to the inner surface of the small space or suspended in the small space, and accordingly, the small space fire extinguisher may be freely installed according to the shape of the small space, so that if a fire breaks out, the small space fire extinguisher can be used immediately to achieve initial fire suppression.

According to the present invention, further, the small space fire extinguisher may be provided with the tube sealed firmly on both side ends thereof, thereby ensuring the stability in installation work and high efficiencies in initial fire suppression.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Hereinafter, an explanation on a small space fire extinguisher according to the present invention will be given briefly.

A small space fire extinguisher according to the present invention is installed in a small space to which it is hard for a person to access or where it is difficult to check whether a fire breaks out and is configured to allow a tube to burst if a fire occurs, so that a fire extinguishing agent such as a fire extinguishing liquid or gas, which is accommodated in the tube, spouts and scatters quickly to achieve initial fire suppression. To allow the fire extinguishing agent to be kept accommodated well in the tube, in this case, both sides of the tube are sealed by means of blocking members and coupling members, and if a fire breaks out, accordingly, the fire can be initially suppressed with the fire extinguishing agent stored in the tube.

Now, the small space fire extinguisher according to the present invention will be explained in detail with reference to the attached drawings.

Figure 1:
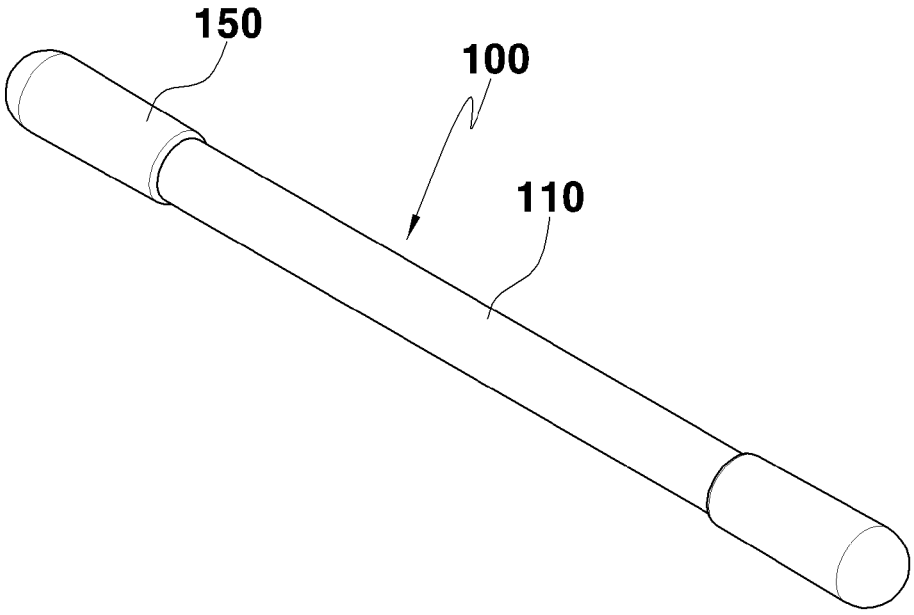
FIG. 1 is a perspective view showing a small space fire extinguisher according to the present invention.
Figure 2:
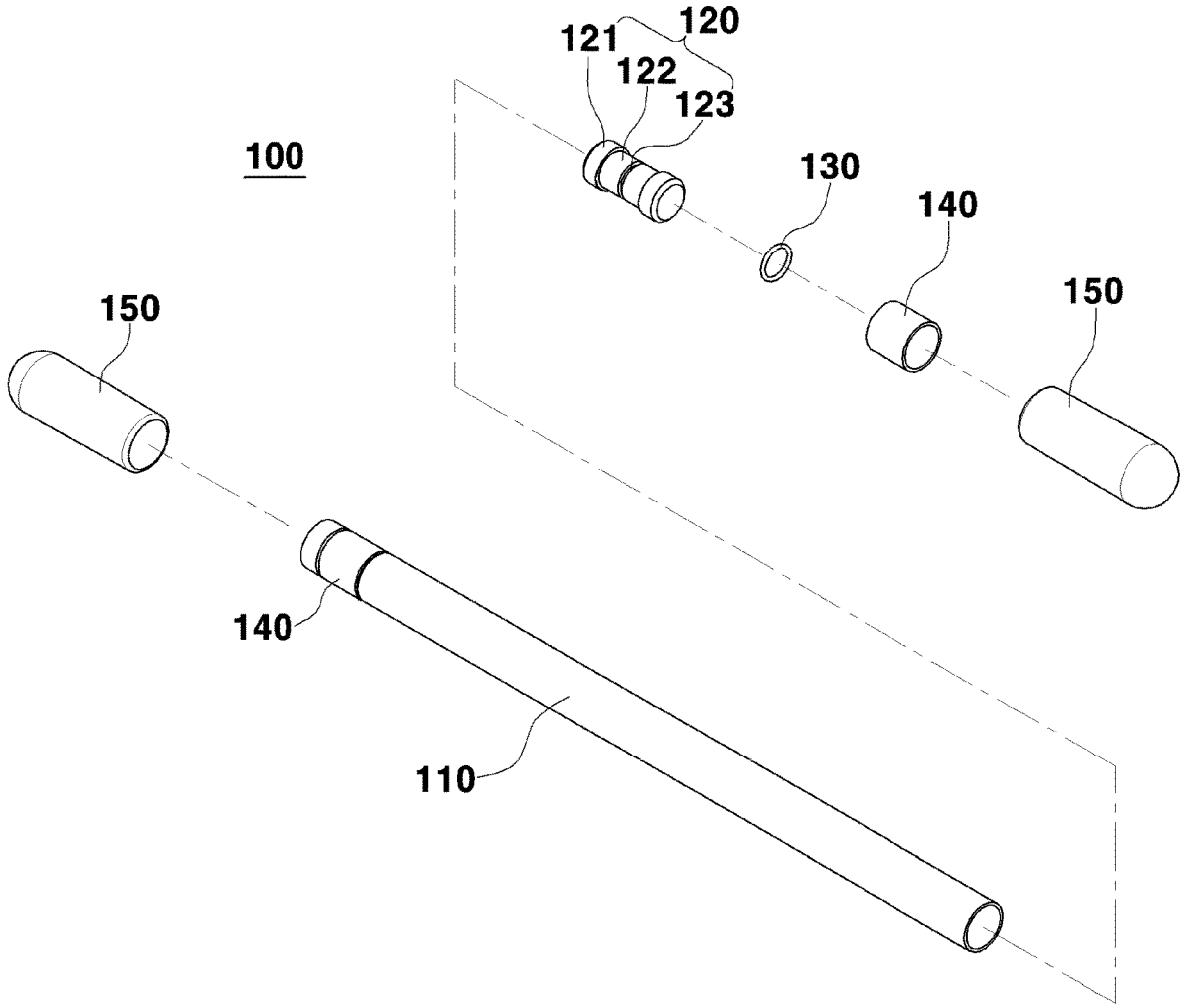
FIG. 2 is an exploded perspective view showing the small space fire extinguisher according to the present invention.
Figure 3:
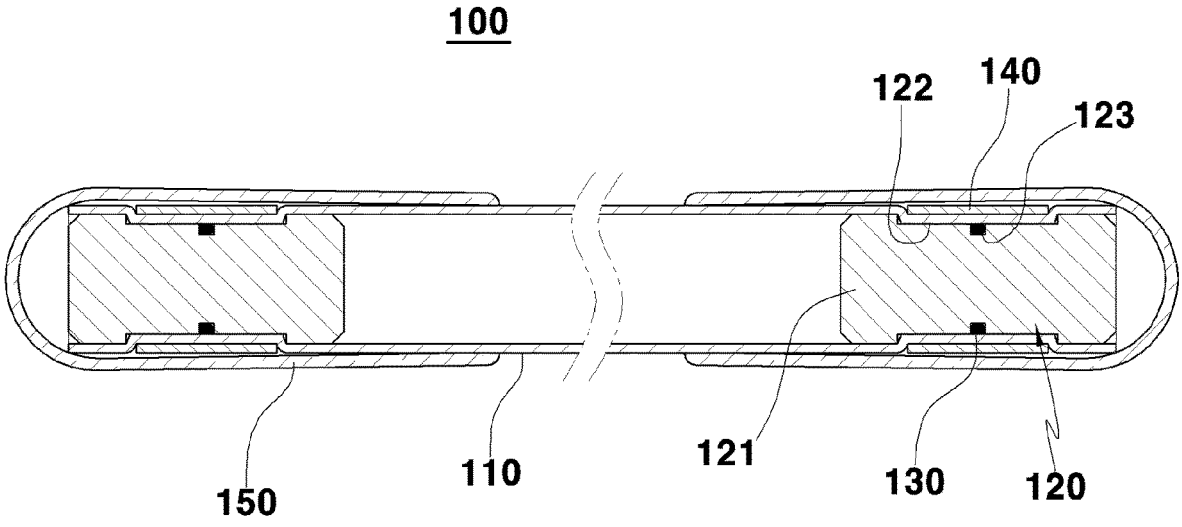
FIG. 3 is a sectional view showing the small space fire extinguisher according to the present invention.
Figure 4:
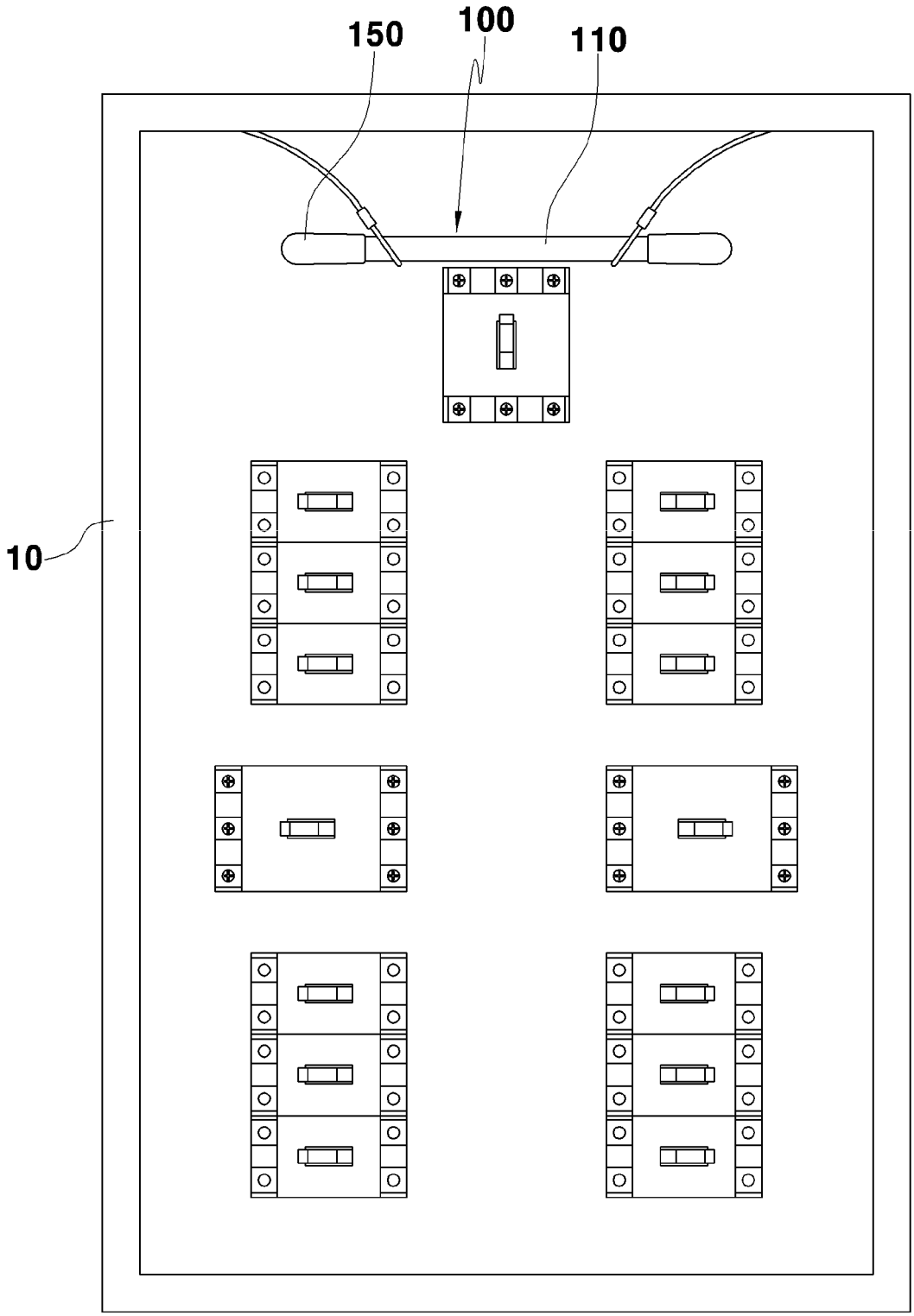
FIG. 4 is an exemplary view showing a state where the small space fire extinguisher is disposed in a small space like a distribution board.

As shown in FIGS. 1 to 4, the small space fire extinguisher 100 according to the present invention includes a tube 110, blocking members 120, packing members 130, coupling members 140, and covers 150.

The tube 110 is open from one side thereof to the other side thereof and is made of a synthetic resin so that a portion thereof bursts by the heat generated when a fire occurs to allow a fire extinguishing agent accommodated in the tube 110 to spout.

The blocking members 120 are cylindrical and coupled to both sides of the tube 110 to prevent the fire extinguishing agent accommodated in the tube 110 from leaking to the outside.

Each blocking member 120 includes a blocking member body 121 inserted into one side end or the other side end of the tube 110, a coupling recess 122 formed on the center of the blocking member body 121 and coupled to the corresponding coupling member 140 fitted to the outer peripheral surface of the tube 110 to allow the coupling member 140 to be fixed to the tube 110 by means of a compression device so that the fire extinguishing agent can be prevented from leaking to the outside, and an installation groove 123 formed at the center of the coupling recess 122 of the blocking member body 121.

Further, the packing members 130 are fitted to the installation grooves 123 formed on the coupling grooves 122 of the blocking member bodies 121 to prevent the fire extinguishing agent from leaking to the spaces between the tube 110 and the covers 150 through the coupling members 140 fitted to the tube 110 by means of compression.

The coupling members 140 are located on the outer peripheral surface of the tube 110, in the state where the packing members 130 are fitted to the installation grooves 123 of the blocking member bodies 121, and then compressed thereagainst by means of the compression device.

Desirably, each coupling member 140 has the shape of a ring whose diameter is larger than an outer diameter of the tube 110.

Each cover 150 has a "⊃"-shaped section open on one side thereof to form a space at the interior thereof, and in a state where the blocking members 120 to which the packing members 130 are fitted are disposed inside the tube 110, accordingly, the covers 150 are fitted to both side ends of the tube 110 to prevent the coupling members 140 compressedly fixed to the outer peripheral surface of the tube 110 from being exposed to the outside.

Under the above-mentioned configuration, the small space fire extinguisher 100 according to the present invention is fixed, in a small space like a distribution board 10 in which it is hard to install fire detecting or extinguishing equipment such as a fire detector, sprinkler, and the like, to the inner surface of the distribution board 10 by means of a fixing holder, and otherwise, the small space fire extinguisher 100 is fixedly suspended in the air by means of a wire with a hook or latch. Accordingly, the small space fire extinguisher 100 can be used immediately when a fire breaks out.

Referring now to the coupling process of the small space fire extinguisher 100, the packing member 130 is fitted to the installation groove 123 of the blocking member 120, and next, the blocking member 120 is inserted into one side end of the tube 110. After that, the coupling member 140 is located on the outer peripheral surface of the tube 110 at which the packing member 130 is disposed and then compressed against the tube 110 by means of the compression device, so that the blocking member 120 is fixed to the inside of the tube 110.

In the state where the blocking member 120 and the coupling member 140 are installed on one side of the tube 110, the fire extinguishing agent is injected into the other side of the tube 110, and after that, the blocking member 120 to which the packing member 130 is fitted is inserted into the other side end of the tube 110. Next, the coupling member 140 is located on the outer peripheral surface of the tube 110 so that the coupling member 140 is compressedly fixed to the coupling recess 122 at which the packing member 130 is disposed.

The coupling member 140 is fitted to the outer peripheral surface of the tube 110 and then compressed against the tube 110 by means of the compression device, so that the blocking member 120 is fixed to the inside of the tube 110.

The blocking members 120 fixed to the inside of the tube 110 can prevent the fire extinguishing agent from leaking to the spaces between the tube 110 and the blocking members 120 by means of the packing members 130.

After the above-mentioned coupling process, the small space fire extinguisher 100 according to the present invention is installed in a small space like a distribution board 10 in which it is hard to install fire detecting or extinguishing equipment for initial fire suppression if a fire breaks out, such as a fire detector, sprinkler, and the like, so that the initial fire suppression can be achieved.

For example, the small space fire extinguisher 100 on the distribution board 10 may be fixed to a wall surface or a ceiling of the distribution board 10, and otherwise, the small space fire extinguisher 100 may be suspended in the air.

If the small space fire extinguisher 100 is fixed to the distribution board 10, at least two or more fixing holders (not shown) are installed on the ceiling or wall surface of the inner side of the distribution board 10, and the fixing holders are fixedly located on portions of the tube 110 where the covers 150 are fitted, so that if a fire breaks out, the tube 110 bursts to inject the fire extinguishing agent stored therein, thereby performing initial fire suppression.

If the small space fire extinguisher 100 is suspended in the air inside the distribution board 10, a wire is provided to allow one side to be fixed to the ceiling of the inner side of the distribution board 10 through a screw and to mount a hook or latch on the other side thereof, so that the tube 110 is fixedly suspended in the air on the inner surface of the distribution board 10.

If a fire breaks out in the state where the small space fire extinguisher 100 is installed in a small space like the distribution board 10, the tube 110 bursts by the heat generated from the fire, and simultaneously, the fire extinguishing agent stored in the tube 110 at a given pressure spouts to block the contact of air with a portion where the fire breaks out, thereby performing initial fire suppression.

As mentioned above, the small space fire extinguisher 100 according to the present invention is installed in small spaces, such as the interiors of home appliances, distribution boards, and the like, where it is hard to easily recognize the occurrence of fires, and if a fire breaks out, the tube 110 bursts to allow the fire extinguishing agent stored therein to spout and scatter quickly, thereby performing initial fire suppression to prevent the fire from spreading and to achieve fire suppression with ease.

Further, the small space fire extinguisher 100 according to the present invention is adjusted in size according to the size of the small space where it is installed.

In addition, the small space fire extinguisher 100 according to the present invention is fixed to the inner surface of the small space or suspended in the small space, and accordingly, the small space fire extinguisher 100 can be freely installed according to the shape of the small space, so that if a fire breaks out, the small space fire extinguisher 100 can be used immediately to achieve initial fire suppression. Further, the tube 110 is sealed firmly on both side ends thereof, thereby ensuring the stability in installation work.

In the description, the components of the present invention are in specific provided, but it should be understood that they are provided in the specific embodiments of the specific invention, being not limited to any invention or claims. The characteristics of the present invention disclosed in individual embodiments may be combined in a single embodiment, and contrarily, the characteristics of the present invention disclosed in a single embodiment can be provided in a plurality of embodiments individually or even in an appropriate secondary combination.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A fire extinguisher comprising:

a tube open from one side thereof to the other side thereof and made of a synthetic resin so that a portion thereof bursts by a heat generated when a fire breaks out to allow a fire extinguishing agent accommodated therein to spout;

cylindrical blocking members coupled to both sides of the tube to prevent the fire extinguishing agent accommodated in the tube from leaking to an outside;

coupling members located on an outer peripheral surface of the tube, in a state where packing members are fitted to installation grooves of blocking member bodies, and then compressed thereagainst; and covers fitted to both side ends of the tube in a state where the cylindrical blocking members to which the packing members are fitted are disposed inside the tube, to prevent the coupling members compressedly fixed to the outer peripheral surface of the tube from being exposed to the outside, wherein each cylindrical blocking member of the cylindrical blocking members comprises:

a blocking member body of said blocking member bodies inserted into one side end or the other side end of the tube;

a coupling recess formed on a center of the blocking member body and coupled to a corresponding coupling member of the coupling members fitted to the outer peripheral surface of the tube to allow the corresponding coupling member to be fixed to the tube so that the fire extinguishing agent is prevented from leaking to the outside; and the installation groove formed at the center of the coupling recess of the blocking member body, wherein the packing members configured to prevent the fire extinguishing agent from leaking to spaces between the tube and the covers through the coupling members compressedly fitted to the tube, and wherein each coupling member of the coupling members has the shape of a ring whose diameter is larger than a diameter of the tube.

* * * * *